United States Patent [19]

Kirchweger et al.

[11] 4,184,471

[45] Jan. 22, 1980

[54] SOUND PROOF ENCAPSULATED ENGINE, ESPECIALLY AN INTERNAL COMBUSTION ENGINE

[75] Inventors: Karl Kirchweger; Gerhard Thien; Heinz Fachbach, all of Graz, Austria

[73] Assignee: Hans List, Graz, Austria

[21] Appl. No.: 899,317

[22] Filed: Apr. 24, 1978

[30] Foreign Application Priority Data

May 6, 1977 [AT] Austria ..... 3260/77

[51] Int. Cl.[2] ..... F02B 77/00; F01P 1/02

[52] U.S. Cl. ..... 123/198 E; 123/41.7; 181/204

[58] Field of Search ..... 123/198 E, 195 C, 195 S, 123/41.7; 181/204

[56] References Cited

U.S. PATENT DOCUMENTS

| | | | |
|---|---|---|---|
| 2,177,687 | 10/1939 | Bracken et al. | 123/198 E |
| 3,412,724 | 11/1968 | Scheiterlein | 123/198 E |
| 3,880,134 | 4/1975 | Thieu et al. | 123/198 E |
| 3,949,727 | 4/1976 | Thieu et al. | 123/198 E |
| 3,964,462 | 6/1976 | Thieu et al. | 123/198 E |

*Primary Examiner*—Ira S. Lazarus

*Attorney, Agent, or Firm*—Watson, Cole, Grindle & Watson

[57] ABSTRACT

A sound proof encapsulated engine, particularly an internal combustion engine, comprising a fan and an intermediate support for the fan, the fan being driven by an elastic element and mounted on the engine case with the aid of the intermediate support by means of a number of bearing faces, the fan bearing housing and the fan drive being accommodated within the encapsulation, and between the engine case and each of the bearing faces being provided an intermediate support having n elastic and body-transmitted sound-absorbing element.

4 Claims, 5 Drawing Figures

SOUND PROOF ENCAPSULATED ENGINE, ESPECIALLY AN INTERNAL COMBUSTION ENGINE

BACKGROUND OF THE INVENTION

This invention concerns a sound proof encapsulated engine, particularly an internal combustion engine of the kind comprising a fan which is driven by means of an elastic element and mounted on the engine case by means of an intermediate supporting or carrier element, and whereby the bearing element or housing of the fan and the fan drive are accommodated within the noise-suppressing encapsulation.

DESCRIPTION OF THE PRIOR ART

In existing arrangements of this kind the fan is secured on an engine shaft either completely rigidly or at most with the interposition of comparatively rigid rubber pads designed to reduce torsional vibrations. The fan shaft carries the fan blade and is also required to transmit the required driving torque. Frequently the fan is on a common shaft with the radiator pump flanged directly to the engine case by means of an intermediate rigid and tubular carrier element which mostly also serves as bearing housing for the fan and the pump shafts.

The noise-suppressing capsule or casing around an encapsulated engine has the functional purpose to prevent air-transmitted sound emission of engine noise from the capsule interior. However, any parts of the engine or ancillary machinery which are secured to an engine shaft or to the engine case and, for constructional or thermal consideration, must be located outside the capsule, will necessarily carry the noise which is produced by the engine out of the capsule and give rise to air-transmitted noise emission on the outside, thereby at least partially cancelling out the noise-suppressing effect of the capsule. The above-mentioned rubber pads which are occasionally provided for absorption of torsional vibrations cannot provide effective insulation with regard to sound transmission through solid body parts because they must be comparatively hard in order to withstand the fan loads to which they are subject. A noise-suppressed, encapsulated internal combustion engine of the kind hereinbefore specified is disclosed in Austrian Patent Specification No. 308 475 wherein the bearing housing for the fan, which is also adapted as a waterpump housing, as well as the fan drive are all accommodated within the suppressor capsule, the rotating fan shaft being conducted out of the capsule and at the point where it actually breaks through the capsule walls it is provided with a tubular absorption silencer, surrounding the shaft with annular clearance and lined with an appropriate sound-absorbing material. However, while achieving a certain degree of noise reduction, such an arrangement cannot be entirely satisfactory with regard to engine noise absorption in this region.

SUMMARY OF THE INVENTION

It is the aim of the present invention to prevent engine noise emission to the exterior of the capsule by solid parts or body sound transmission, or resonance, through those engine unit parts and components which penetrate through said capsule walls but have to be mounted on, or secured to, the actual engine case itself.

This aim is realised, according to the present invention, but the provision of an elastic and body-transmitted sound-absorbing insulator element at each bearing face between the engine case and the intermediate support or carrier element.

Thanks to the provision of this invention the above-mentioned drawbacks appertaining to existing arrangements can be completely obviated. The interposition of an elastic and body-transmitted-sound-absorbing element for each bearing face between the intermediate support and the engine case provides a suspension system for the fan which is soft and therefore capable of absorbing body-transmitted-noise. This very largely prevents all sound transmission through solid parts from the interior to the outside of the suppressor capsule.

In further development of this invention the intermediate support or carrier may comprise three legs of unequal lengths. This has the advantage of enabling a free choice of relative distances between the axis of rotation of the fan and the bearing faces on the intermediate support, so that these distances may in all cases be selected of the maximum value compatible with the given mounting facilities on the engine unit.

According to a still further development of this invention, the intermediate support as well as the body-transmitted-sound-absorbing element, or elements, may also be arranged within the suppressor capsule and only a portion of the fan bearing housing extends outwardly through the capsule walls. Such an arrangement provides the advantage of only a single break through the capsule walls and consequently just one point or region in the capsule which requires acoustic insulation, with the added bonus that fan belt and fan bearing noises are also contained within the capsule.

Finally, the improvements resulting from this invention are perfected by the provision of an annular gap between the capsule and the fan-bearing-housing part which projects outwardly from the capsule, the gap being sealed by a flexible seal which is secured to the bearing housing and to the capsule preferably in the form of a concertina-pleated rubber boot. The annular gap permits small movements of the fan relative to the capsule walls without making contact therewith, and also allows some leeway for assembly inaccuracies. The seal, if provided in the form of a pleated rubber boot, can adapt very easily to any such relative movements and, because it is secured to the bearing housing as well as to the capsule, it provides a particularly effective and durable seal for the annular gap in regard to airborne sound transmission.

DESCRIPTION OF THE DRAWINGS

The invention will be hereinafter more specifically described with reference to some embodiments illustrated in the accompanying drawings, by way of example, wherein.

DESCRIPTION OF THE PREFERRED EMBODIMENTS

Figure 2:
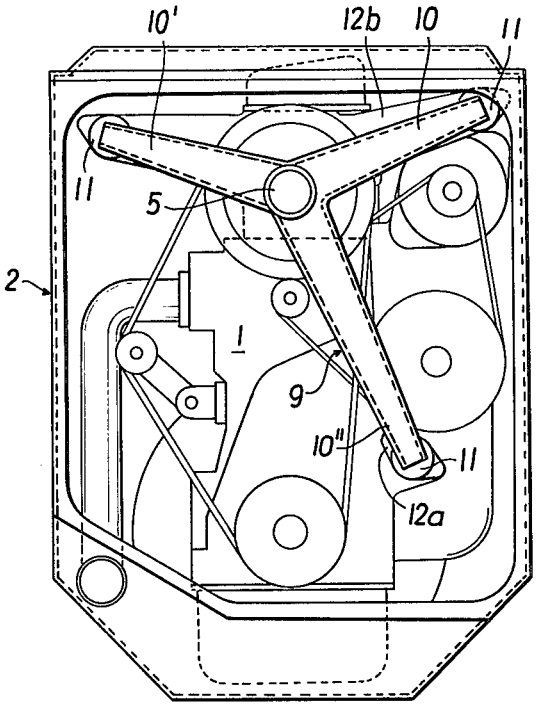
FIG. 2 is a top view of the engine according to FIG. 1.
Figure 3:
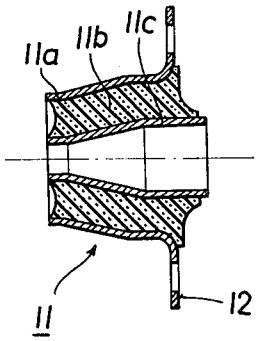
FIG. 3 is an enlarged detail.

The engine case 1 is surrounded by a noise-suppressing outer casing, the so-called suppressor capsule 2. From this capsule emerges the fan 3 comprising the fan blade 4 which is situated externally of the capsule 2, the fan-bearing housing 5 which is partially outside the capsule 2, and the fan drive 6, which includes the V-belt pulley 7 and the fan belt 8. The fan 3 is secured by its bearing housing 5 on an intermediate support or carrier element 9 which has three legs 10, 10', 10'', as shown in FIG. 2. The intermediate support 9 itself is mounted on the engine case 1 with the interposition of elastic and body-transmitted sound-absorbing elements 11 at each of the bearing faces 12, the latter being spaced as far away from the rotating axis 13 of the fan 3 as possible within the capsule 2. The elastic and body-transmitted sound-absorbing elements 11 (see FIG. 3) are conventional, each comprising an outer ring 11*a* of hollow cylindrical or cup-like form with an elastic ring 11*b*, preferably made of rubber, secured to its inside wall by vulcanizing, and a conical bearing part 11*c* vulcanized inside said elastic inner ring 11 concentrically with the outer ring 11*a* and to which the intermediate support 9 is secured in a convenient and appropriate manner, not here specifically illustrated, e.g. by means of screw bolts passing therethrough. The elastic and body-transmitted-sound-absorbing elements 11 are screwed with their bearing faces 12 to bearing blocks 12*a*, 12*b* which latter are either cast integrally with the engine case or formed separately and bolted thereto. At the point where the fan bearing housing 5 passes through the capsule 2 there is a clear annular gap 14 which permits some displacement of the fan by elastic deformation of the elements 11 without making contact with the capsule 2. To complete the acoustic seal for the engine capsule, this annular gap 14 is sealed off by a flexible seal 15, preferably in the form of a concertina-pleated rubber boot.

Figure 1:
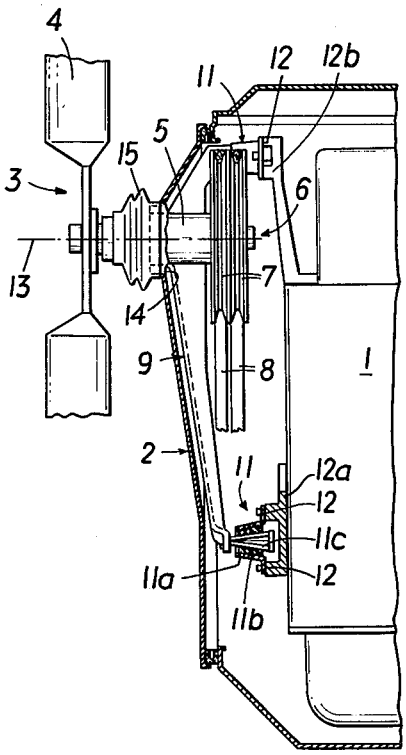
FIG. 1 is a sectional view of a noise suppressor capsule according to a first embodiment of this invention, showing the fan, the intermediate support and the fan drive in elevation.
Figure 4:
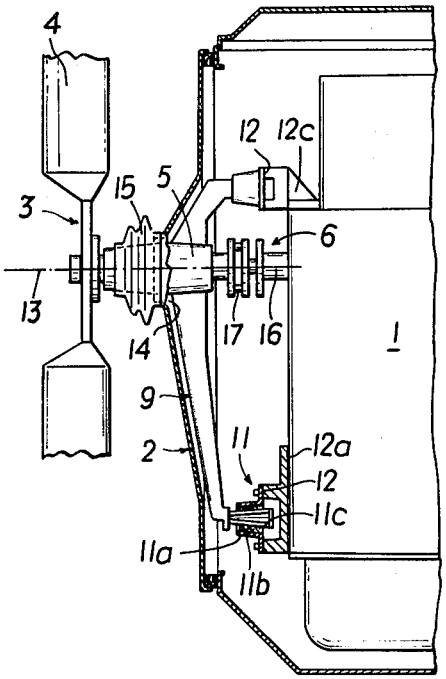
FIG. 4 is a view similar to FIG. 1 and shows another embodiment of the invention.
Figure 5:
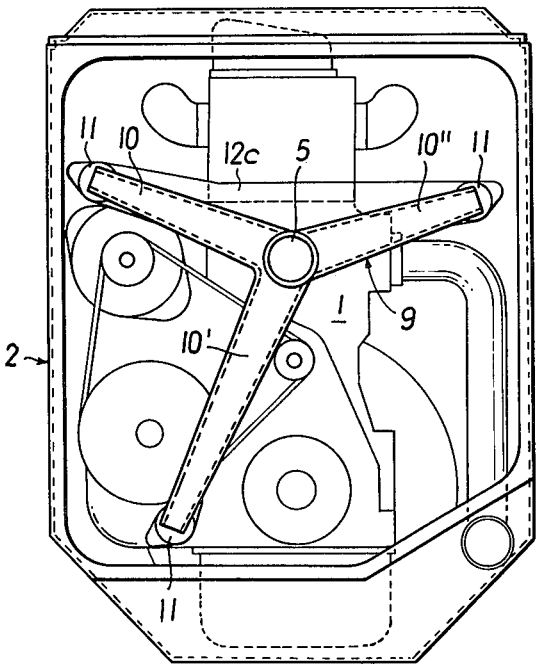
FIG. 5 is the corresponding top view of the FIG. 4 embodiment.

FIGS. 4 and 5, in analogous manner to FIGS. 1 and 2 respectively, also show the same arrangement with regard to the fan 3 and the intermediate support 9, but in association with a different type of elastic fan drive 6. Like parts carry like reference numerals as in FIGS. 1 and 2. In this arrangement drive is transmitted directly from an engine shaft 16 by means of a resilient rubber coupling 17. On the left hand side in FIG. 4 there is also shown a further bearing block 12*c*.

We claim:

1. A sound proof encapsulated engine, particularly an internal combustion engine, comprising an engine case, a sound-suppressing outer casing surrounding said engine case, a fan, a fan shaft supporting said fan, a housing surrounding said shaft, a fan drive coupled with said shaft, an intermediate support mounted on said housing and being secured to said engine case for supporting said fan, said support being secured to said engine case by means of a plurality of elastic sound-absorbing elements respectively located at a plurality of bearing points, said housing lying partially within said outer casing, and said fan drive, said intermediate support and said sound-absorbing elements being disposed wholly within said outer casing.

2. The engine according to claim 1, wherein said intermediate support comprises a support assembly having a plurality of legs corresponding to said plurality of bearing points, said sound-absorbing elements being disposed between said legs and said engine case, and said bearing points being spaced remote distances from the rotational axis of said fan.

3. The engine according to claim 2, wherein three of said legs are provided for said assembly, and said legs being of unequal length.

4. The engine according to claim 1, wherein said housing extends partially outwardly of said outer casing and is spaced therefrom by an annular gap between said housing and said casing, sealing means closing said gap and extending between and secured to said housing and said casing, said sealing means comprising a concertina-pleated rubber boot.

* * * * *